US005596943A

United States Patent [19]

Horton

[11] Patent Number: 5,596,943

[45] Date of Patent: Jan. 28, 1997

[54] APPARATUS AND METHOD FOR FLOATING A TOWED DEVICE FROM A SUBMERGED VEHICLE

[75] Inventor: Duane M. Horton, Portsmouth, R.I.

[73] Assignee: The United States of America as represented by the Secretary of the Navy, Washington, D.C.

[21] Appl. No.: 521,380

[22] Filed: Aug. 16, 1995

[51] Int. Cl.[6] ..... B63G 8/14

[52] U.S. Cl. ..... 114/245; 114/331

[58] Field of Search ..... 441/1, 2, 6, 9, 441/15, 28, 29, 30, 31, 98; 440/44; 104/61, 245, 312, 330, 331, 333, 121, 125

[56] References Cited

U.S. PATENT DOCUMENTS 3,794,965 2/1974 Charske ..... 114/245

4,709,355 11/1987 Woods et al. ..... 114/245

4,993,348 2/1991 Wald ..... 114/61

*Primary Examiner*—Stephen Avila

*Attorney, Agent, or Firm*—Michael J. McGowan; James M. Kasischke; Prithvi C. Lall

[57] ABSTRACT

A vehicle towed by a submerged vehicle is surfaced with improved speed, reliability and efficiency by displacing water from within the towed vehicle with gases evolved by electrolysis within the towed vehicle. Positive buoyancy is thus derived and the attitude of the towed vehicle is controllably altered so that hydrodynamic lift is also produced to rapidly surface the towed vehicle.

17 Claims, 4 Drawing Sheets

APPARATUS AND METHOD FOR FLOATING A TOWED DEVICE FROM A SUBMERGED VEHICLE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention generally relates to deployment of floatable devices from submerged vessels or vehicles without requiring the vehicle to surface and, more particularly, to flotation of devices towed from a submerged vehicle.

(2) Description of the Prior Art

Submersible vehicles are known and used, with a wide variety of adaptations, for many diverse purposes. In such fields as undersea rescue, exploration and salvage, it is known to deploy manned or unmanned submersible devices from a manned submerged vessel or vehicle. The submersible device, if unmanned, may be towed by cable or controlled remotely though communication links provided in a cable which connects the submersible device to the manned vessel.

Towed vehicles or payloads often may be much more readily surfaced than the manned or programmed-course unmanned vehicle for purposes which can be carried out only at the water surface. The deployment of a radio antenna for communication is a common example of such a purpose, particularly in the case of a programmed-course unmanned vehicle which must periodically obtain position data from a navigational system communicating by radio such as a global positioning system (GPS).

One known method for surfacing a payload is to tow a positively buoyant vehicle on a long cable. Positive buoyancy causes the payload to rise until that positive buoyancy is balanced by downward forces from the cable which will trail the towing vehicle in a curved form due to hydrodynamic drag on the cable itself. Then, as the towing vehicle slows, the cable will become more vertically oriented until the towed payload or vehicle reaches the water surface. However, the drag on the towing cable may be substantial and a significant fraction of the hydrodynamic drag on the towing vehicle, limiting potential speed thereof until the towed payload can carry out its function and be recovered to the submerged vessel. Further, the positive buoyancy can have a significant adverse and somewhat unpredictable effect on the trim of the towing vessel since the towing cable will exert a force on the towing vehicle which will seldom pass through the center of pressure thereof. If the buoyant payload is towed from the stern of the towing vessel, control of depth may become very difficult and compromise the success of surfacing the buoyant payload.

The above described technique can also be modified by use of a specialized run profile as disclosed in U.S. Pat. No. 5,379,034. While useful and advantageous for some specialized purposes, such as the possible application, disclosed therein, to deployment of a Global Positioning System antenna buoy from an unmanned towing vehicle whereby the need for a large, variable buoyancy system sufficient to rapidly surface the towing vehicle is avoided, this modification has the added disadvantage of requiring highly accurate knowledge of towing vehicle velocity, buoyancy and depth as well as limiting the time the payload can be kept on the surface.

It has also been proposed to tow the buoyant payload or deploy it directly from an extendable mast or to use the mast directly for the surface mission, such as radio communication. However, such an extendable mast would require a significant portion of the payload of the towing vehicle and does not avoid but, rather, aggravates the problems associated with hydrodynamic drag and may adversely affect static stability as well as dynamic trim of the towing vessel.

The separation of liquid water into its gaseous components of hydrogen and oxygen by electrolysis is, of course, well-known and a classic demonstration experiment in science classes. Pure water is a very poor conductor of electricity; but when a small amount of an electrolyte, such as an acid, base, or salt, is dissolved in water, the resulting solution readily conducts an electric current. As is generally known, when a current of electricity is passed through a solution of an electrolyte, the ions of the electrolyte are the agencies that carry the current; the ions migrate toward the two electrodes, the positive ions (cations) moving toward the negative electrode (cathode) and the negative ions (anions) moving toward the positive electrode (anode). This process is called electrolysis. When an electric current is passed through water containing a small amount of an electrolyte, such as $H_2SO_4$, NaOH, $Na_2SO_4$, NaCl, and so forth, bubbles of hydrogen are formed at the cathode and oxygen is evolved at the anode. The volume of hydrogen produced is twice that of the oxygen. The net reaction can be summarized by the equation $$2H_2O+\text{electricity}\rightarrow 2H_2\rightarrow +O_2\rightarrow$$

It must be borne in mind that the equation only shows what products are formed; it does not suggest a mechanism, which is more complex than suggested by this simple equation alone. For example, if NaCl is used in dilute, non-concentrated levels as an electrolyte in an aqueous solution subjected to electrolysis, it is known that both chlorine gas and oxygen can be generated at the anode while the hydrogen is being formed at the cathode. It is also known that if the aqueous sodium chloride solution is made very dilute, then little chlorine is formed at the anode in addition to the oxygen formed during electrolysis. Suffice it to say that it is an understood principle of basic chemistry, that depending upon the concentration and type of salt constituents present in an aqueous solution, formation of another type of gas, viz. chlorine, is possible in addition to the oxygen and hydrogen formed during electrolysis of water.

In any event, despite the possibility of explosion if, for example, the two gases of oxygen and hydrogen are allowed to mix and then ignited, some practical applications of such a process have been at least proposed. For example, in U.S. Pat. No. 5,167,786 to William J. Eberle, an arrangement for collection of wave-power is proposed. In that system, a toroidal float encircling a central tower moves up and down under the influence of tides and waves, driving a DC generator. Power from the generator is used to separate oxygen and hydrogen by electrolysis and the resulting gases are then pressurized and stored in the toroidal float in order to store the generated gases until they are retrieved. However, since the gas is pressurized and stored in the toroidal float, the buoyancy of the toroidal float is reduced by the added mass of separated gases although, presumably, the gases would be collected before positive buoyancy of the toroidal float was lost or significantly compromised.

SUMMARY OF THE INVENTION

It is therefore an object of the present invention to provide a method and apparatus for surfacing a towed payload from a submerged vessel which has reduced effect on towing vessel trim and which can be surfaced without requiring specialized maneuvers.

It is another object of the invention to provide a method and apparatus for surfacing and resubmerging a payload carried by a towed vehicle with improved efficiency and rapidity and with increased independence from maneuvering of the towing vehicle.

It is a further object of the invention to provide a method and apparatus for reliably controlling payload buoyancy and attitude from a submerged towing vehicle.

In order to accomplish these and other objects of the invention, there is a method of surfacing a payload carried by a submerged vehicle containing water including the steps of electrolyzing the water into its constituent gases, and displacing water from within the submerged vehicle with the constituent gases to increase positive buoyancy.

In one further aspect, the inventive method has the additional step of altering a location of a center of buoyancy of the submerged vehicle. In another aspect, the method can have the further steps of towing the submerged vehicle, and causing hydrodynamic lift in response to alteration of the location of the center of buoyancy. It is also within the scope of the invention to provide for additional steps of confining the constituent gases produced by the electrolysis step to surface the submerged vehicle, and controllably releasing/venting the confined constituent gases to submerge the vehicle.

The present invention also concerns a surfaceable vehicle having means for electrolyzing water into its constituent gases, and means for displacing a fluid from the vehicle with the constituent gases to increase positive buoyancy of the vehicle. This surfaceable vehicle of the invention can further include means for towing the surfaceable vehicle.

In another aspect, the surfaceable vehicle can further include ballasting means for adjusting a center of buoyancy of the surfaceable vehicle relative to a center of gravity of the surfaceable vehicle. Further, the ballasting means can include at least one expandable gas-filled enclosure. Means can be provided for altering location of a center of buoyancy of the surfaceable vehicle with the constituent gases themselves. Further, the means employed for altering a location of a center of buoyancy of the surfaceable vehicle can be a means for constraining movement of the constituent gases.

In yet another aspect of the surfaceable vehicle of the invention, the surfaceable vehicle includes means for separately collecting and confining each of said constituent gases. Further, the surfaceable vehicle can include at least one bladder capable of confining gas and displacing a fluid from said vehicle to increase positive buoyancy of said vehicle. This aspect can be brought about by positioning electrodes in communication with at least one bladder in which electrodes are capable of electrolyzing water into its constituent gases.

In one further aspect, the surfaceable vehicle has a body shell including openings permitting entry of fluid into said vehicle. Also, a towing cable can be attached to the surfaceable vehicle so that it can be towed by a towing vehicle.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DESCRIPTION OF THE PREFERRED EMBODIMENT

Figure 1:
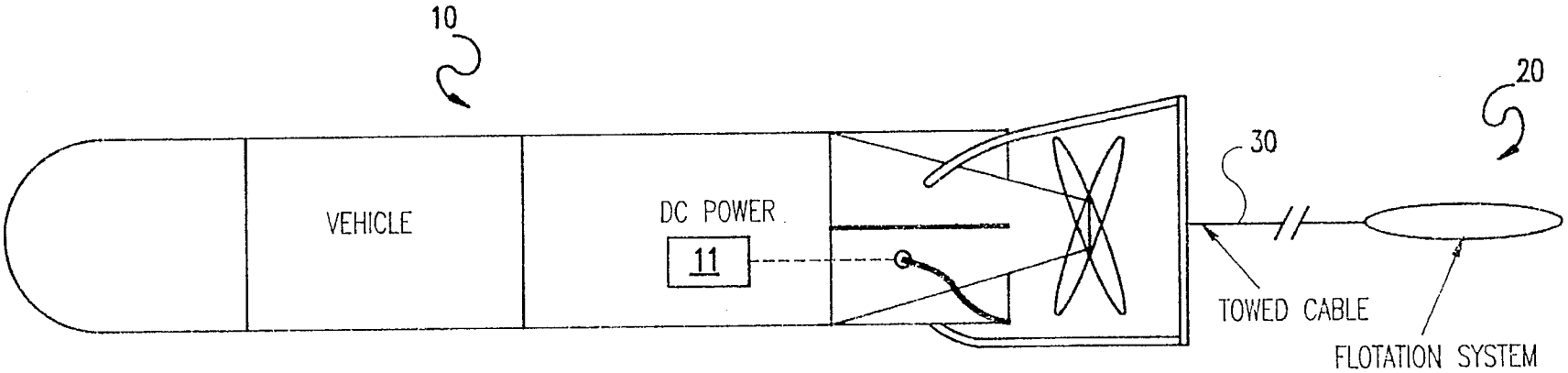
FIG. 1 illustrates the combination of a towing and towed vehicle in accordance with the invention.

Referring now to the drawings, and more particularly to FIG. 1, there is shown a submerged towing vehicle 10 and a surfaceable towed vehicle 20 in accordance with the invention; the latter being towed by cable 30, connecting the two. The form and details of the towing vehicle are substantially unimportant to the practice of the invention except that the towing vehicle should have some provision for developing motive power and include a current source 11 such as a battery, generator, fuel cell or the like for generating DC current. Alternatively, the current source 11 could be placed in towed surfaceable vehicle 20 with the advantage that only control signals (e.g., electrical or optical) but not electrical power would need to be supplied to the towed vehicle 20 through cable 30. While the latter alternative may seem preferable in terms of cable cost, inclusion of a generator in the surfaceable towed vehicle 20 is not practical because the towed vehicle 20 should have substantially neutral buoyancy.

Figure 2:
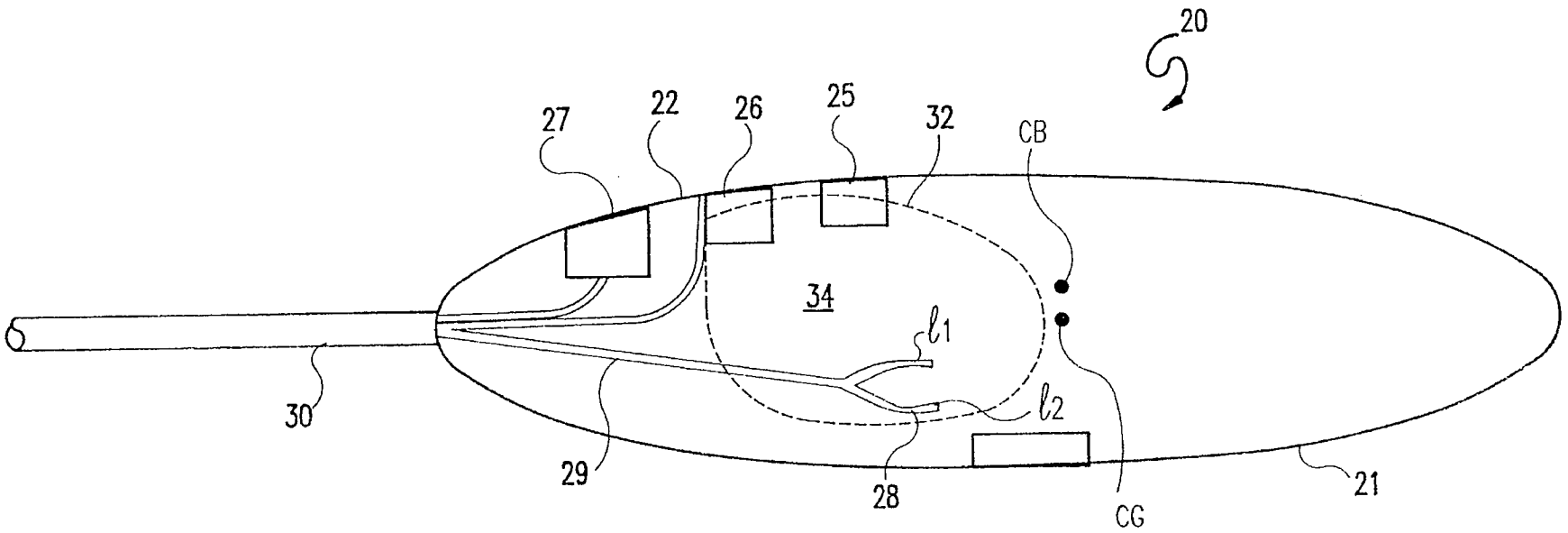
FIG. 2 is a more detailed and enlarged side view of the surfaceable vehicle in accordance with the invention prior to commencement of a surfacing operation.

As shown in FIG. 2, the towed vehicle 20 in accordance with the invention preferably includes a rigid or semi-rigid body shell 21, preferably in the shape of a prolate spheroid. This shape is considered preferable since the general symmetry reduces effects on trim of the towing vehicle 20 regardless of orientation; the overall contour and elongation in the towing direction reduces hydrodynamic drag; and the width providing some degree of stability when surfaced. Shell 21 is typically porous or otherwise free flooding, to allow it to fill with seawater.

A relief valve 25 is also preferably provided and may be most advantageously located on the upper forward quadrant 22 of the surface of shell 21. This is also a desirable location for a solenoid valve 26 and payload 27 since, as will be described below, this surface of the towed vehicle 20 will, when flotation is achieved, form the uppermost portion thereof. Relief valve 25 is a standard pressure-actuated valve in communication with a bladder 32 to release gas from bladder 32 if subjected to a preset pressure difference. Solenoid valve 26 is an electrically controlled valve joined by cable 30 to a controller located aboard towing vehicle 10.

The towed vehicle 20 is also provided with electrodes 28, generically illustrated in FIG. 2, which are in contact with water containing an electrolyte (e.g., seawater). For purposes of this invention, the term "seawater" means the water of the sea, containing in solution, on the average, approximately 2.8% sodium chloride and other salts. In the illustration of FIG. 2, the electrodes 28 are constituted by a pair of corrosion resistant electrodes l1, l2 maintained in a spatially separated relationship. Electrodes 28 are positioned in communication with one or more bladders 32 in the towed vehicle 20. In the preferred embodiment, electrodes 28 will be sealed in a container having a preset amount of electrolyte solution 34 such as a very dilute water acid solution.

Shell 21 of the towed vehicle is porous or has openings provided therein so that the remainder of the towed vehicle 20 will be filled with seawater. When a voltage is applied to electrodes 28, a current will flow separating the liquid water into two constituent gases, hydrogen ($H_2$) and oxygen ($O_2$). Both hydrogen and oxygen have relatively high vapor pressures even at water temperatures which may be near the freezing point of water and will thus be in a gaseous form which displaces a far greater weight of water than the weight of the respective gases. Thus, as these gases are evolved and contained within the towed vehicle 20 while seawater is driven out, positive buoyancy of the towed vehicle 20 will be achieved and increased.

The towing cable 30 is attached firmly to the towed vehicle 20. The attachment is preferably provided on the longitudinal axis of the towed vehicle 20 in the horizontal plane of symmetry of the towed vehicle 20 so that no lift is caused by angle of incidence of the towed vehicle 20 attitude. Thus, relatively high towing speeds can be achieved while minimizing drag and trim effects on the towing vehicle 10 which are attributable to the towed vehicle 20.

The towing cable 30, however, preferably includes an electrical or optical communications link and an insulated wire 29 capable of carrying at least several amperes of current to spatially separated electrodes 28.

When the towed vehicle 20 is approximately neutrally buoyant, the towed vehicle 20 is preferably ballasted, advantageously with gas-filled balloons or bladders, such that the center of buoyancy, CB, is directly above the center of gravity, CG. The upward displacement of the center of buoyancy contributes to the stability of the attitude of the towed vehicle 20. Because the towing cable 30 is normally neutrally buoyant, towed vehicle 20 will be maintained directly behind towing vehicle 10 during operation.

Figure 3:
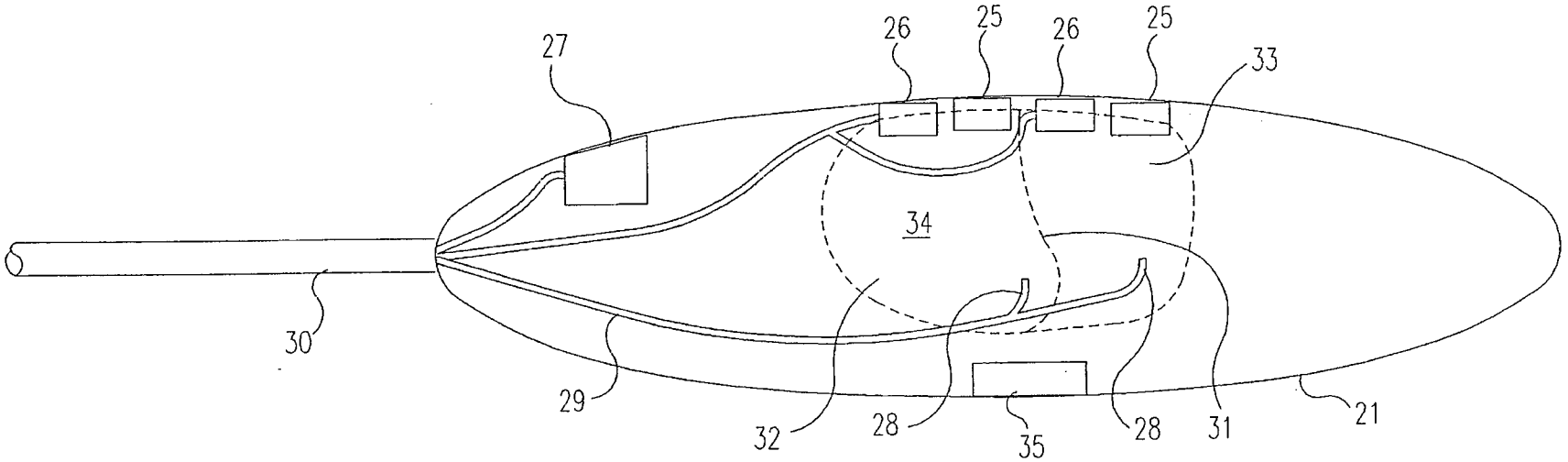
FIG. 3 is a side view of one embodiment of the surfaceable vehicle during surfacing.

As illustrated in FIG. 3, the rigid or semi-rigid shell 21 preferably includes a structure such as a bulkhead 31 located at approximately the center of buoyancy when the towed vehicle 20 is approximately neutrally buoyant. This structure is preferably used to locate one or more bladders 32, 33 which will contain gases which are evolved by the electrolysis process. In accordance with the invention, it is desirable that the center of buoyancy gradually shift forward with increasing positive buoyancy so that the angle of attack will increase and increasing amounts of hydrodynamic lift will be produced. Increased drag will also occur which may be useful in slowing the towing vehicle 10.

This forward shift of the center of buoyancy is preferably achieved by providing bulkhead 31 at or slightly in front of the center of buoyancy CB when the towed vehicle 20 is neutrally buoyant and mounting bladders 32, 33 on each of the forward and aft sides of the bulkhead. One of electrodes 28 is placed on the interior of each bladder and an electrical connection 34 provided in contact with the electrolyte solution 34 within each of the bladders 32, 33. The polarity of the voltage applied to the electrodes 28 is then preferably chosen such that hydrogen gas is evolved in the forward bladder 32 and oxygen gas is evolved in the aft bladder 33. Since the volume of hydrogen gas evolved should be approximately twice the volume of oxygen gas evolved, the forward shift of buoyancy will be proportional to the total volume of gas evolved and the increase of positive buoyancy. This effect may be enhanced or adjusted by fabricating the respective bladders 32 and 33 of elastically expansible material such as rubber to alter relative pressures of the evolved gases. Alternatively, such structures as springs, elastic straps or compressible materials such as an open cell foam or sponge material can be provided to resist expansion of either or both gases at particular volumes thereof. For example, at maximum buoyancy, it may be desirable to provide increased fore buoyancy to be greater than the aft buoyancy to prevent the towed vehicle from prematurely resubmerging. This also elevates the payload to the greatest possible height.

As alluded to above, the angle of attack achieved by adjustment of the center of buoyancy at neutral buoyancy can also affect the desired forward shift of the center of buoyancy as gases are evolved. As shown in FIG. 3, assuming no elastic deformation of the bladders 32, 33, (e.g., restricting evolved gas expansion) the attitude of the towed vehicle and the shape of the interior of shell 21 will favor forward movement of the evolved gases regardless of whether single or plural bladders are provided. At the beginning of the surfacing operation when only small amounts of gas have been evolved, the forward movement of gases can be advantageously exploited by allowing gas movement without significant restraint to cause a relatively large initial forward shift of the center of buoyancy with very little evolved gas.

As noted above, the adjustment of the center of buoyancy may be done by small gas-filled balloons positioned in towed vehicle 20. The volume of these balloons will, of course, be a function of both the gas pressure inside them and the hydrostatic pressure of the depth of water at which the vehicle may be submerged at any given time. Therefore, these balloons can assist in the surfacing of the towed vehicle 20 in accordance with the invention since they will increase in volume and thus increase buoyancy of the towed vehicle 20 as the towed vehicle 20 nears the surface during surfacing operations in accordance with the invention. By the same token, however, it is desirable to mount such ballasting balloons near the center of buoyancy since the increase of buoyancy will change most rapidly near the surface and since it is essentially uncontrolled, should not be allowed to severely change the fore-and-aft trim of the towed vessel. Furthermore, the towed vehicle 20 can be provided with ballast 36 to maintain vertical orientation.

Figure 4:
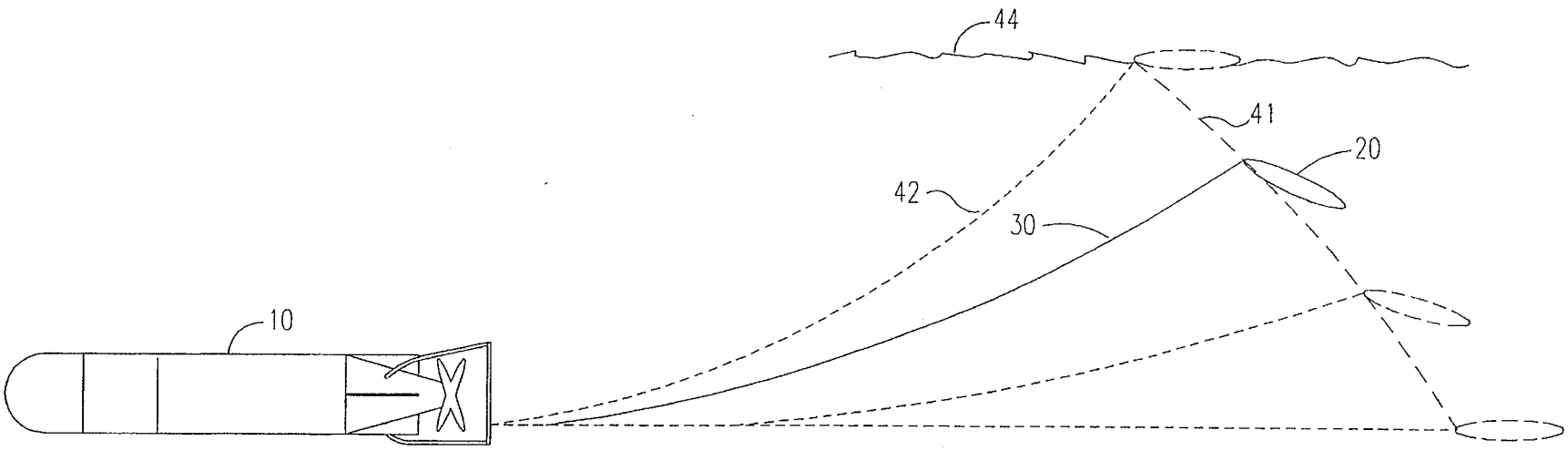
FIG. 4 is an illustration of both the towing and towed vehicle during deployment of the latter.

When it is desired to surface the towed vehicle, solenoid and relief valves are closed and a current is supplied to electrodes 28 to cause electrolysis of sea water or water containing another electrolyte within bladders 32 and 33, and the gases evolved during this process are allowed to move forward to a limited degree while displacing sea water from within shell 21. Positive buoyancy is produced, causing the towed vehicle 20 to begin to rise toward the water surface. At the same time, the forward movement of the gases causes a shift in the center of buoyancy and a gradual increase in the angle of attack (i.e., from a substantially zero angle through angle a to angle b as shown in FIG. 4) and increased hydrodynamic lift as the towed vehicle 20 moves forward, supplementing the positive buoyancy of the towed vehicle 20. Thus, the towed vehicle 20 can be made to surface very rapidly.

Referring now to FIG. 4, to facilitate the surfacing of the towed vehicle 20, the towing vehicle ascends to a shallow depth and decelerates to a minimum speed. As the towed vehicle 20 nears the surface 44, its height above the towing vehicle 20 increases, resulting in greater hydrodynamic drag on tow cable 30 and a greater downward force on towed vehicle 20. Gradually, as the towed vehicle 20 nears the surface, its angle of attack, speed and lift are reduced.

Ideally, the towed vehicle 20 will follow a generally arcuate path profile 41 which will be approximately tangent to the water surface as shown in FIG. 4. By the same token, the drag on the cable and the arcuate shape it can assume (depicted by dashed line 42) due to the substantial positive buoyancy of the towed vehicle 20 developed in accordance with the invention prevents significant change in the angle of the cable at the point it attaches to the towing vehicle 10. Thus, the surfacing of the towed vehicle 20 in accordance with the invention minimizes effects on the trim and maneuverability of the towing vehicle 10.

When it is desired to again submerge towed vehicle 20, a control signal may be sent from the towing vehicle 10 to open solenoid valves 26 to allow the evolved gases to be vented to the atmosphere. Upon venting of bladders 32, 33, seawater enters the shell or bladders 32, 33 to reduce buoyancy until neutral buoyancy is reached. The surfaced towed vehicle 20 supports an increased portion of the weight of the cable 30 which causes a negative angle of attack until the original towing attitude is resumed. Thus, the towed vehicle 10 can be resubmerged very rapidly and the original towing configuration shown in FIG. 1 can be resumed in a reduced period of time.

Of course, as all evolved gas is displaced by sea water, the position of the center of buoyancy will return to the original position shown in FIG. 2, as determined by the original ballasting of the towed vehicle and the original attitude of the towed vehicle 20 will be resumed. If water containing an electrolyte is used to develop evolved gases which are vented, it is preferred that sufficient electrolyte solution be provided to cover electrodes 28 and allow multiple surfacing operations. Alternatively, seawater can be used to produce evolved gases or used to replenish electrolyte solution consumed. It should also be noted that no elaborate maneuvering or path profile need be followed by the towing vessel during the operation of surfacing the payload on the towed vehicle and the surfacing operation can be regarded as independent of the towing vehicle 10 course and vice-versa although depth and speed of the towing vehicle 10 should generally be determined by the length of towing cable used to optimize the towed vehicle surfacing path profile, as may be desired for particular applications and payloads.

In view of the foregoing, it is seen that the invention provides a system and method for more quickly surfacing a payload carried by a towed vehicle and with reduced effect on the trim of the towing vehicle. The invention gains efficiency from the rapidity with which the original towing configuration can be resumed as well as from the electrolysis process itself and with which substantial changes in buoyancy and attitude of the towed vehicle can be, in effect, remotely controlled. Reliability is enhanced since the arrangement provided by the invention has no moving parts other than the valves.

In light of the above, it is therefore understood that within the scope of the appended claims, the invention may be practiced otherwise than as specifically described.

What is claimed is:

1. A method of surfacing a payload comprising the steps of:

providing a surfaceable underwater vehicle having water therein, said payload being located on said vehicle;

electrolyzing said water into its constituent gases; and displacing water from within the submerged vehicle with said constituent gases to increase positive buoyancy.

2. A method as recited in claim 1, further comprising the further step of altering a location of a center of buoyancy of said submerged vehicle during said step of displacing water.

3. A method as recited in claim 2, including the further steps of:

towing said submerged vehicle; and causing hydrodynamic lift in response to alteration of said location of said center of buoyancy.

4. A method as recited in claim 1, comprising the further steps of:

confining said constituent gases produced by said step of electrolyzing; and controllably releasing said confined constituent gases to submerge said vehicle.

5. A surfaceable underwater vehicle comprising:

means for electrolyzing water into its constituent gases; and means for displacing a fluid with said constituent gases to increase positive buoyancy of said vehicle.

6. A surfaceable underwater vehicle as recited in claim 5, further comprising means for towing said surfaceable underwater vehicle.

7. A surfaceable underwater vehicle as recited in claim 5, further comprising ballasting means for adjusting a center of buoyancy of said surfaceable underwater vehicle relative to a center of gravity of said surfaceable underwater vehicle.

8. A surfaceable underwater vehicle as recited in claim 7, wherein said ballasting means comprises at least one expandable gas-filled enclosure.

9. A surfaceable underwater vehicle as recited in claim 5, further comprising means for separately collecting and confining each of said constituent gases.

10. A surfaceable underwater vehicle as recited in claim 5, further comprising means for altering location of a center of buoyancy of said surfaceable underwater vehicle with said constituent gases.

11. A surfaceable underwater vehicle as recited in claim 9, further comprising means for altering location of a center of buoyancy of said surfaceable underwater vehicle with said constituent gases.

12. A surfaceable underwater vehicle as recited in claim 11, wherein said means for altering a location of a center of buoyancy comprises means for constraining movement of said constituent gases.

13. A surfaceable underwater vehicle comprising:

a body shell having openings therein permitting entry and exit of fluid into said body shell;

at least one bladder disposed in said body shell capable of confining gas and displacing a fluid from said vehicle to increase positive buoyancy of said vehicle;

electrodes positioned in communication with said at least one bladder and capable of electrolyzing water into its constituent gases;

a towing cable attached to said body shell; and a payload positioned on said body shell.

14. A surfaceable underwater vehicle as recited in claim 13, wherein said body shell has a prolate spheroid shape.

15. A surfaceable underwater vehicle as recited in claim 13, wherein said at least one bladder includes means to controllably vent confined gases.

16. A surfaceable underwater vehicle as recited in claim 13, wherein said towing cable further comprises electrical current transmission means capable of transmitting electrical current between a direct current source and said electrodes.

17. A surfaceable underwater vehicle as recited in claim 13, wherein said towing cable includes a communication link means to said underwater vehicle, said communication link means being joined to said payload and to said means to controllably vent confined gases.

* * * * *